US006371039B1

(12) United States Patent
Hemphill

(10) Patent No.: US 6,371,039 B1
(45) Date of Patent: Apr. 16, 2002

(54) COLLAR ASSEMBLY FOR WATERCRAFT

(75) Inventor: Douglas H. Hemphill, Delta (CA)

(73) Assignee: Zodiac Hurricane Technologies, Inc., Delta (CA)

( * ) Notice: Subject to any disclaimer, the term of this patent is extended or adjusted under 35 U.S.C. 154(b) by 0 days.

(21) Appl. No.: 09/490,999

(22) Filed: Jan. 25, 2000

Related U.S. Application Data

(60) Provisional application No. 60/168,402, filed on Dec. 1, 1999.

(51) Int. Cl.[7] ..... B63B 59/02; B63B 7/00
(52) U.S. Cl. ..... 114/219; 114/345
(58) Field of Search ..... 114/68, 123, 219, 114/345

(56) References Cited

U.S. PATENT DOCUMENTS 2,698,447 A * 1/1955 Potts et al. ..... 114/345
4,063,320 A * 12/1977 Neumann et al. ..... 114/345
4,520,746 A * 6/1985 Walters et al. ..... 114/69
4,928,619 A * 5/1990 Cochran ..... 114/345
4,966,091 A * 10/1990 De Suarez D'Aulan .... 114/345
5,215,031 A * 6/1993 Inman et al. ..... 114/360
5,878,685 A 3/1999 Hemphill

OTHER PUBLICATIONS

Pages 2/16 and 3/16 of material of Le Compte–Holland b.v. (date unknown; available to the assignee before Dec. 1, 1999).
Three pages of material of Osborne Rescue Boats Ltd. (date unknown; available to the assignee before Dec. 1, 1999).

* cited by examiner

*Primary Examiner*—S. Joseph Morano
*Assistant Examiner*—Andrew D. Wright
(74) *Attorney, Agent, or Firm*—Dean W. Russell; Kilpatrick Stockton LLP

(57) ABSTRACT

Collar assemblies for use with watercraft including rigid-hulled boats are disclosed. Collars of the assemblies may surround or envelope all or most of the perimeters of boats and provide increased buoyancy at least at their sterns. The collars typically are split, rather than continuous, both to facilitate installation and to reduce risk of damage during the installation process.

12 Claims, 3 Drawing Sheets

COLLAR ASSEMBLY FOR WATERCRAFT

REFERENCE TO PROVISIONAL APPLICATION

This application is based on and hereby refers to U.S. Provisional Patent Application Ser. No. 60/168,402, filed Dec. 1, 1999, having the same title as appears above.

FIELD OF THE INVENTION

This invention relates to collars and associated components useful in conjunction with watercraft and more particularly to collars adapted to surround or envelope most or all of the perimeters of boats to which they are attached in use.

BACKGROUND OF THE INVENTION

U.S. Pat. No. 5,878,685 to Hemphill, et al., incorporated herein in its entirety by this reference, illustrates and describes foam collar systems for boats. Also discussed in the Hemphill, et al. patent are numerous other patents disclosing such things as inflatable flotation collars and foam stabilizing members for various watercraft. Although potentially useful for multiple purposes, the collars and members described in these patents do not extend about the entire perimeters of the hulls to which they are intended to be attached.

The Dutch company Le Comte promotes a rigid-hulled boat having what it calls a "wrap-around stern." As depicted in literature of Le Comte, the boat includes a continuous inflatable collar surrounding its perimeter, with the collar extending behind the hull of the boat above its outboard motor. According to the literature:

> The wrap-around version has the collar running the entire periphery of the hull, positioned on the concave collar resting-guards, which also transverse [sic] the stern and form an integral part of the transom.

Placing the collar wholly above the motor may, however, be disadvantageous, as the buoyancy of the collar cannot readily prevent the motor from being submerged under certain conditions.

Other continuous "wrap-around" collars may exist (at least outside the United States) for boats having inboard engines, with the collars likely attached directly to the sterns of the rigid hulls of the boats. Whether employed with boats having inboard or outboard engines, these continuous collars typically are fitted from the tops of boats, requiring cranes or other equipment to suspend the collars over the hull peripheries and lower them thereonto. Antennae and hull superstructures conceivably may be damaged by contact with the collars during the fitting operation, as may the collars themselves through contact with the antennae or superstructures.

SUMMARY OF THE INVENTION

The present invention provides alternative collar assemblies for use with watercraft including rigid-hulled boats. Of the "wrap-around" type described by Le Comte, the assemblies incorporate a split, rather than continuous, collar both to facilitate installation and to reduce the risk of damage during the installation process. Versions of the collars designed for use with boats having outboard engines additionally can provide buoyancy counteracting certain effects of rough seas (or ramp launches by the stern), reducing the possibility of the engines becoming completely submerged. Whether inflatable or made of foam (or other material), the collars of the present invention preferably (although not necessarily) are attached to an engine guard extending from the sterns of many boats, thus utilizing existing components in addition to the hulls for support.

Although those skilled in the art will recognize that split portions of the innovative collar assemblies disclosed herein may exist anywhere around the periphery of a particular boat, for many boats the split portion of the assembly will be is positioned at the stern of its associated boat. In this circumstance, the ends of the collar adjacent the split may be covered with a common piece material effectively functioning as a sling when connected to the engine guard. Irrespective of the location of the ends, covering them with a common piece of material also inhibits air and water from flowing between the ends, which might otherwise tend to try to separate them at high boat speeds or in rough seas.

It thus is an object of the present invention to provide collar assemblies extending substantially or completely about the peripheries of various watercraft.

It is another object of the present invention to provide collar assemblies which, at least because they extend around sterns of craft, provide increased buoyancy.

It is a further object of the present invention to provide collar assemblies which may be installed other than by lowering them onto the external surfaces of boat hulls, thus reducing risk of damage caused by contact with antennae or superstructures protruding upward from the hulls.

It is also an object of the present invention to provide collar assemblies which do not include a continuous collar, but rather a split one with (at least) two distinct ends.

It is, moreover, an object of the present invention to provide collar assemblies in which collars are connected to engine guards extending outward from sterns of craft.

It is yet another object of the present invention to provide collar assemblies in which a common piece of material covers adjacent ends of a collar.

Other objects, features, and advantages of the present invention will be apparent to those skilled in the art with reference to the remainder of the text and the drawings of this application.

DETAILED DESCRIPTION

Figure 1:
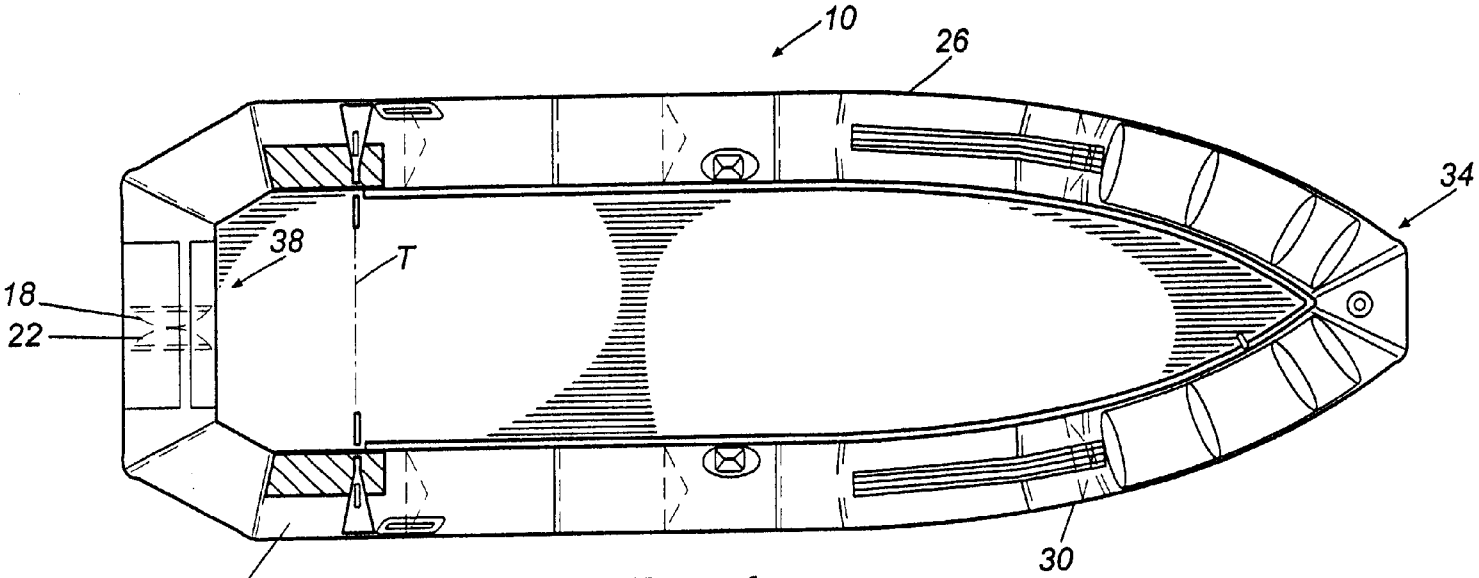
FIG. 1 is a top plan view of an exemplary collar assembly consistent with the present invention.

FIG. 1 details an exemplary assembly 10 consistent with the present invention. Assembly 10 may be used with any suitable watercraft or otherwise as desired. One such suitable watercraft with which assembly 10 may be used is the boat depicted generically in FIG. 1 of the Hemphill, et al. patent, although those skilled in the art will recognize that numerous other boats may be suitable as well.

Included as part of assembly 10 is collar 14. Collar 14 typically has a majority circular cross-section and is designed to provide buoyancy to the watercraft to which it is attached. In some embodiments of assembly 10, collar 14 may be made of Hypalon or other waterproof fabric or material inflated with air or other gas. In other embodiments, collar 14 may be made of foam (such as that of the Hemphill, et al. patent). Again, however, collar 14 may be formed or configured differently than described herein and nevertheless remain within the scope of the present invention.

The wrap-around collars referenced in the preceding sections of this application are continuous, at least in that they have no defined end points or pieces. By contrast and as shown in FIG. 1, collar 14 is discontinuous, defining ends 18 and 22. Although ends 18 and 22 often will abut in use, as illustrated in FIG. 1, they need not do so in all circumstances.

Additionally consistent with FIG. 1, ends 18 and 22 may be positioned at the stern of the watercraft with which collar 14 is associated. Collar 14 may thus consist further of port and starboard sections 26 and 30, respectively, and bow section 34. If inflatable, each of sections 26, 30, and 34 may include one or more valves or other mechanisms for filling with gas.

Additionally if inflatable, each section 26, 30, or 34 may define one or more chambers, some or all of which may be inflatable and may but need not necessarily communicate with one or more other chambers.

Figure 2:
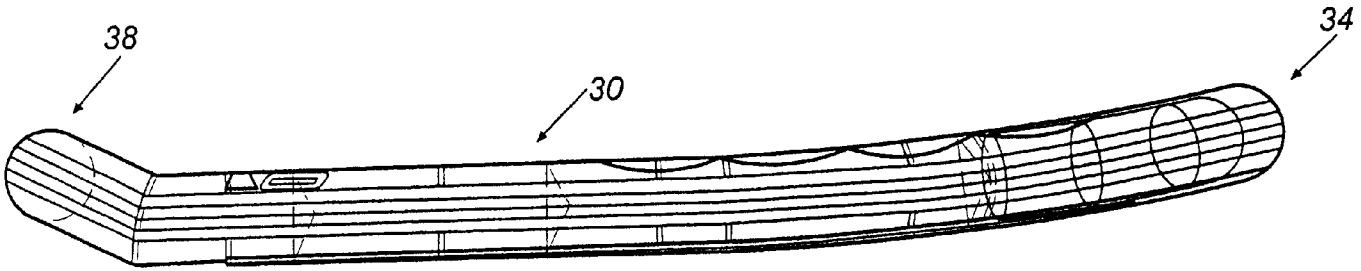
FIG. 2 is a side elevational view of the collar assembly of FIG. 1.

FIG. 2 details starboard section 30 of collar 14 together with portions of bow section 34 and stern section 38.

According to FIG. 2, collar 14 need not have the same absolute elevation throughout its length. Instead, for example, it may slope upward toward bow section 34 and be canted upward at stern section 38. Canting stern section 38 upward facilitates use of outboard motors with boats associated with collar assemblies 10, although canting it too far above the static waterline may inhibit its ability to prevent outboard motors from becoming submerged from time to time. Preferably, therefore, stern section 38 of collar 14 will be positioned so that it indeed is useful to reduce the possibility of outboard motors submerging yet typically sufficiently above the nominal waterline to avoid interference with proper use of the outboards.

Figure 3:
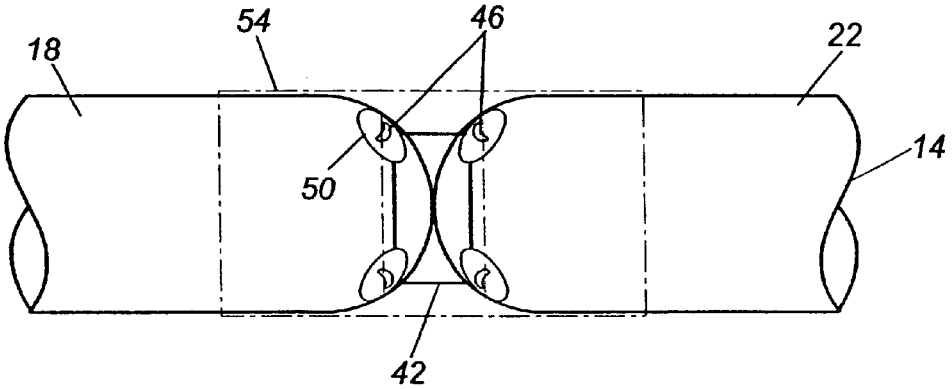
FIG. 3 is a side elevational view of the ends of the collar included as part of the assembly of FIG. 1.

Ends 18 and 22 of stern section 38 of collar 14 are illustrated in greater detail in FIG. 3. As shown, ends 18 and 22 are sealed from the environment (and from each other) so that collar 14 lacks continuity about the entire periphery of the boat with which it is associated. Preferably (although not necessarily), however, ends 18 and 22 will abut in a manner similar to that depicted in FIG. 3 along the approximate center line of the associated boat, with cord 42 laced through D-rings 46 to retain ends 18 and 22 in position. D-rings 46 may be held within fabric patches 50 and glued or otherwise affixed to the material of collar 14 in any conventional or suitable manner.

Firmly connecting ends 18 and 22 using cord 42 reduces the ability of turbulent wind or water flow to separate ends 18 and 22 and force them away from each other when in use. Ends 18 and 22 need not be connected, however, or may be connected other than by using cord 42 and D-rings 46. Likewise, ends 18 and 22 need not be positioned at the approximate center line of the associated boat but rather may appear elsewhere as appropriate or desired.

Figure 4:
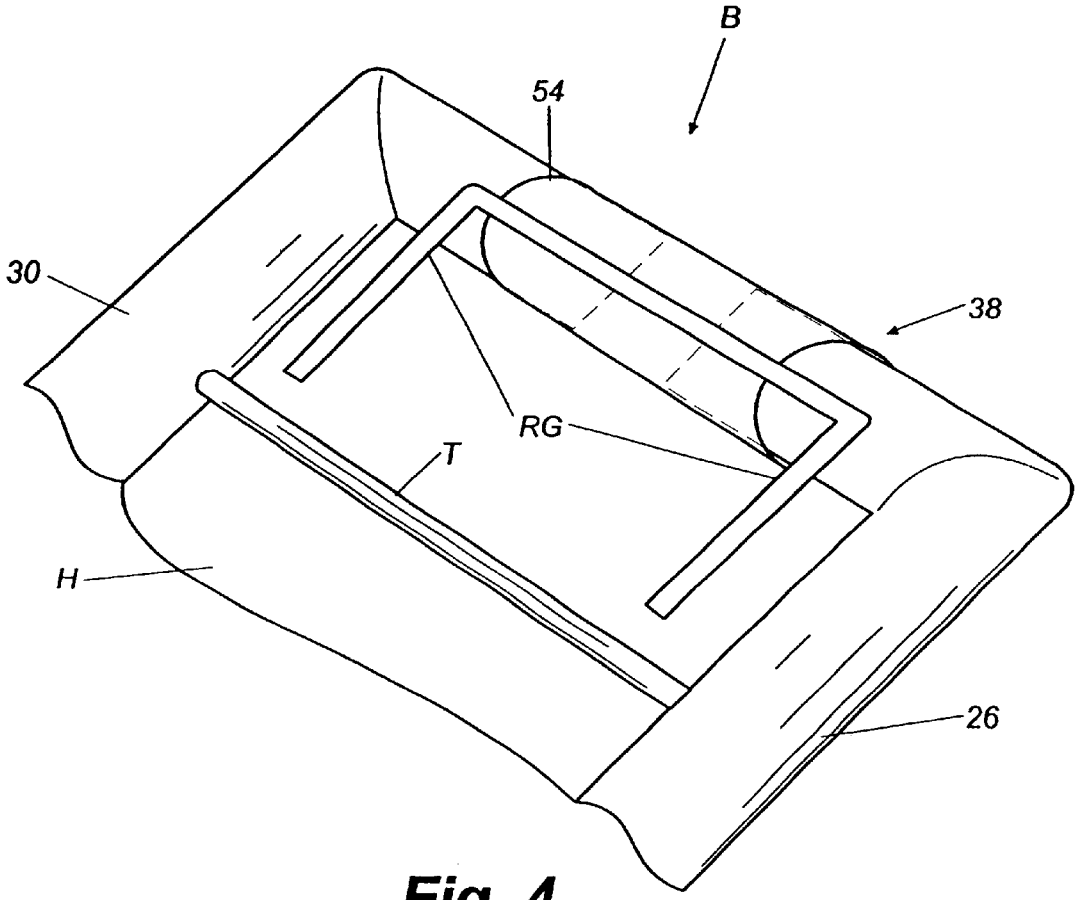
FIG. 4 is a partially schematicized top plan view of portions of the collar assembly of FIG. 1 including the ends of the collar of FIG. 3.

FIGS. 3 and 4 additionally show exemplary means for attaching stern section 38 to an associated boat B. As illustrated (partially schematically) in FIG. 4, boat B may include a hull H and a transom T behind and above which a metal support bar having an engine guard RG may protrude. Wrapping strap 54 around ends 18 and 22 and attaching it to guard RG permits the strap 54 to function as a sling, thereby supporting ends 18 and 22 and connecting them to boat B. Stern section 38 thus is neither unsupported nor attached directly to hull H—in contrast with other wrap-around collars—and, as illustrated in FIGS. 1 and 3, may extend significant distance behind transom T to reduce possible interference with any outboard motors used to power boat T.

Figure 5:
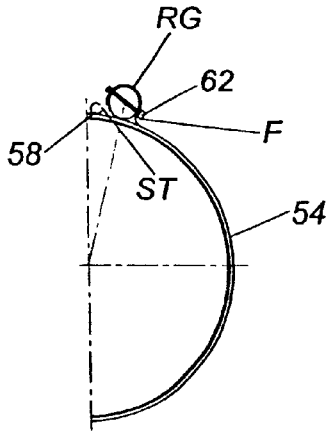
FIG. 5 is a cross-sectional view of the collar of FIG. 3 illustrating its attachment to the engine guard of a boat.

Strap 54 may be made of any material (including but not limited to Hypalon fabric) sufficiently durable to withstand operation for extended periods in marine environments while supporting ends 18 and 22. Although attachment of strap 54 to guard RG may occur in any suitable fashion, a preferred approach to doing so is illustrated in FIG. 5. In this approach, a first edge 58 of strap 54 is placed within a split tube portion ST of guard RG and clamped thereby. Strap 54 is then wrapped around most (essentially all) of the circumference of stern section 38 in the areas of ends 18 and 22 so that its opposed edge 62 contacts guard RG. Eyelets or other openings along edge 62 of strap 54 may then be bolted or connected with fasteners F to guard RG, thus allowing guard RG and strap 54 to support ends 18 and 22. Strap 54 additionally functions as a cover for ends 18 and 22, further inhibiting the ability of turbulent wind and water to separate the ends 18 and 22.

Figure 6:
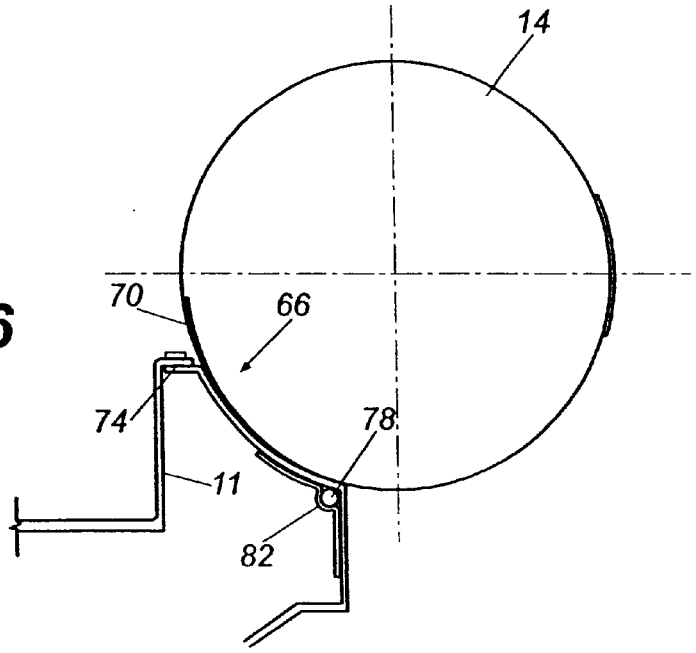
FIG. 6 is a cross-sectional view of the collar of FIG. 3 illustrating its attachment to the hull of a boat.

FIG. 6, finally, provides an example of equipment 66 useful as part of collar assembly 10 for connecting collar 14 to hull H. Equipment 66 may include any or all of an attachment strip 70 adhered or otherwise connected to collar 14 and extending generally longitudinally thereon. Eyelets or other openings formed in strip 70 and any suitable fasteners 74 may be used to fasten collar 14 to hull H.

Additionally, if collar 14 has cord 78 affixed longitudinally to portions of its exterior, the cord 78 may be threaded through pipe 82 and retained in a complementary portion of hull H. Attaching a continuous collar to hull H in this manner would be difficult (if not practically impossible), contributing to the need for collar 14 to be split in one or more places as described previously. So forming collar 14 thus enhances its versatility, as in many cases the collar 14 may be mounted to or installed on hull H in myriad ways without significant likelihood of damage either to it or to any portion of the boat superstructure. Nevertheless, however, other connection equipment and techniques obviously may be used instead.

The foregoing is provided for purposes of illustrating, explaining, and describing embodiments of the present invention. Further modifications and adaptations to these embodiments will be apparent to those skilled in the art and may be made without departing from the scope or spirit of the invention.

I claim:

1. A collar assembly which in use functions as a fender of a boat hull and comprises an elongated material having two distinct ends that abut rearward of the hull, the elongated material (i) being sufficiently flexible to wrap around the hull and surround its entire perimeter and (ii) having a length exceeding the distance comprising the perimeter.

2. A collar assembly according to claim 1 further comprising a strap for supporting the two ends.

3. A collar assembly according to claim 2 further comprising means for attaching the elongated material to the hull.

4. A collar assembly according to claim 1 in which the elongated material is inflatable.

5. A collar assembly according to claim 1 in which the elongated material is made of foam.

6. A collar assembly according to claim 1 further comprising an attachment strip connected to the elongated material and extending generally longitudinally thereon.

7. A boat comprising:

a. a hull defining a perimeter and a stern;

b. a collar surrounding the perimeter as a fender therefor and attached to the hull but not directly to the stern, the collar being split so as to define two separate ends positioned rearward of the stern;

c. a support bar connected to the hull and extending from the stern; and d. a strap supporting the two ends of the collar and attached to the support bar.

8. A boat according to claim 7 further comprising means for connecting one of the two ends of the collar to the other end.

9. A boat according to claim 7 further comprising an engine guard connected to the hull and extending from the stern and in which the strap is attached to the engine guard.

10. A boat according to claim 7 in which the collar is inflatable.

11. A boat according to claim 7 in which the collar is made of foam.

12. A boat according to claim 7 in which the strap is attached to the support bar so as to form a sling supporting the two ends of the collar.

* * * * *